US007445816B2

(12) United States Patent
Dattilo

(10) Patent No.: US 7,445,816 B2
(45) Date of Patent: Nov. 4, 2008

(54) METHOD AND APPARATUS FOR COATING A SUBSTRATE

(75) Inventor: Vincent P. Dattilo, Strongsville, OH (US)

(73) Assignee: PPG Industries Ohio, Inc., Cleveland, OH (US)

( * ) Notice: Subject to any disclaimer, the term of this patent is extended or adjusted under 35 U.S.C. 154(b) by 790 days.

(21) Appl. No.: 10/686,246

(22) Filed: Oct. 15, 2003

(65) Prior Publication Data

US 2004/0081770 A1 Apr. 29, 2004

Related U.S. Application Data

(63) Continuation-in-part of application No. 09/969,478, filed on Oct. 2, 2001, now Pat. No. 6,641,666, which is a continuation-in-part of application No. 09/440,367, filed on Nov. 15, 1999, now Pat. No. 6,296,706.

(51) Int. Cl.

| | |
|---|---|
| ***B05D 1/26*** | (2006.01) |
| ***B05D 1/34*** | (2006.01) |
| ***B05D 5/06*** | (2006.01) |
| ***B05B 7/04*** | (2006.01) |

(52) U.S. Cl. ..... 427/426; 118/302; 366/184; 366/189

(58) Field of Classification Search ..... 427/426; 118/302; 366/184, 189

See application file for complete search history.

(56) References Cited

U.S. PATENT DOCUMENTS

| | | | | |
|---|---|---|---|---|
| 3,512,502 | A | 5/1970 | Drum | 118/624 |
| 3,952,699 | A | 4/1976 | Durr et al. | 118/315 |
| 3,979,535 | A | 9/1976 | Govindan | 427/422 |
| 4,148,932 | A | 4/1979 | Tada et al. | 427/31 |
| 4,239,431 | A | 12/1980 | Davini | 414/1 |
| 4,241,646 | A | 12/1980 | Tsuruta et al. | 98/115 |
| 4,342,535 | A | 8/1982 | Bartlett et al. | 414/744 A |
| 4,342,536 | A | 8/1982 | Akeel et al. | 414/744 A |
| 4,358,026 | A | 11/1982 | Makinen | 222/1 |
| 4,362,124 | A | 12/1982 | Fleig | 118/698 |
| 4,397,422 | A | 8/1983 | Gwyn | 239/307 |
| 4,498,414 | A | 2/1985 | Kiba et al. | 118/663 |

(Continued)

FOREIGN PATENT DOCUMENTS

| | | |
|---|---|---|
| DE | 3301022 | 7/1984 |

(Continued)

OTHER PUBLICATIONS

Takeuchi Toru, "Paint Supply Apparatus," JP 61-171527 (Abst.).*

(Continued)

*Primary Examiner*—Michael Cleveland
*Assistant Examiner*—Robert Vetere
(74) *Attorney, Agent, or Firm*—Robert A. Diaz; Deborah M. Altman

(57) ABSTRACT

A method of applying a coating onto a substrate includes providing a coating source having a plurality of color components, dynamically blending selected color components to form a plurality of coating materials of selected color, directing the coating materials to separate reservoirs, and selectively directly a coating material from one or more of the reservoirs over the substrate by one or more applicators.

21 Claims, 6 Drawing Sheets

U.S. PATENT DOCUMENTS

| | | | | | |
|---|---|---|---|---|---|
| 4,521,462 | A | | 6/1985 | Smythe | 427/421 |
| 4,532,148 | A | | 7/1985 | Vecellio | 427/31 |
| 4,539,932 | A | | 9/1985 | Vecellio | 118/697 |
| 4,552,506 | A | | 11/1985 | Cummins et al. | 414/735 |
| 4,630,567 | A | | 12/1986 | Bambousek et al. | 118/323 |
| 4,714,044 | A | | 12/1987 | Kikuchi et al. | 118/314 |
| 4,721,630 | A | | 1/1988 | Takeo et al. | 427/421 |
| 4,728,034 | A | | 3/1988 | Matsumura et al. | 239/112 |
| 4,738,219 | A | * | 4/1988 | Fujisawa | 118/666 |
| 4,771,729 | A | | 9/1988 | Planert et al. | 118/697 |
| 4,781,949 | A | | 11/1988 | Kasari | 427/407.1 |
| 4,827,993 | A | | 5/1989 | Ito et al. | 141/83 |
| 4,881,563 | A | | 11/1989 | Christian | 134/166 |
| 4,902,352 | A | | 2/1990 | Christian | 134/22.12 |
| 4,928,880 | A | | 5/1990 | Prus et al. | 239/8 |
| 5,065,695 | A | | 11/1991 | Baron et al. | 118/688 |
| 5,100,690 | A | | 3/1992 | Planert et al. | 427/33 |
| 5,130,167 | A | | 7/1992 | Mitsuji et al. | 427/407.1 |
| 5,192,609 | A | | 3/1993 | Carroll, Jr. | 428/328 |
| 5,230,739 | A | | 7/1993 | Bartow | 118/694 |
| 5,254,173 | A | | 10/1993 | Myers | 118/728 |
| 5,401,790 | A | | 3/1995 | Poole et al. | 524/199 |
| 5,554,416 | A | | 9/1996 | Scheufler et al. | 427/378 |
| 5,620,750 | A | | 4/1997 | Minoura et al. | 427/421 |
| 5,645,895 | A | * | 7/1997 | Murayama et al. | 427/424 |
| 5,647,535 | A | * | 7/1997 | Nakazono et al. | 239/7 |
| 5,718,061 | A | | 2/1998 | Scheufler et al. | 34/475 |
| 5,871,827 | A | * | 2/1999 | Jaffe et al. | 428/29 |
| 5,879,755 | A | | 3/1999 | Takahashi et al. | 427/475 |
| 5,916,625 | A | | 6/1999 | Rosenberger et al. | 427/8 |
| 5,945,218 | A | | 8/1999 | Nakao et al. | 428/403 |
| 5,968,268 | A | | 10/1999 | Kitano et al. | 118/52 |
| 5,981,080 | A | * | 11/1999 | Rockrath et al. | 428/522 |
| 6,238,746 | B1 | * | 5/2001 | Fukuoka et al. | 427/424 |
| 6,494,608 | B1 | * | 12/2002 | Retamal et al. | 366/132 |
| 2002/0069822 | A1 | | 6/2002 | Dattillo | 118/612 |
| 2002/0122892 | A1 | | 9/2002 | Dattilo | 427/421 |
| 2004/0028823 | A1 | * | 2/2004 | Dutt | 427/385.5 |

FOREIGN PATENT DOCUMENTS

| | | | | |
|---|---|---|---|---|
| DE | 3441604 | A1 | | 7/1985 |
| DE | 3727081 | A | | 2/1989 |
| EP | 0038127 | | | 10/1981 |
| EP | 0122034 | | | 10/1984 |
| EP | 0338871 | | | 10/1989 |
| EP | 0388931 | A2 | | 9/1990 |
| EP | 0402181 | A1 | | 12/1990 |
| EP | 0525867 | A1 | | 2/1993 |
| EP | 0589340 | A1 | | 3/1994 |
| EP | 0664163 | A1 | | 7/1995 |
| EP | 0899023 | | | 3/1999 |
| GB | 2007833 | | | 5/1979 |
| GB | 2087264 | | | 5/1982 |
| GB | 2114024 | | | 8/1983 |
| GB | 2319194 | | | 5/1998 |
| JP | 56-144763 | | | 8/1986 |
| JP | 61171527 | | | 8/1986 |
| JP | 04171068 | | | 6/1992 |
| JP | 06226154 | | | 8/1994 |
| JP | 10080649 | | | 3/1998 |
| WO | 89/06181 | | | 7/1989 |
| WO | WO 89/06181 | | * | 7/1989 |
| WO | WO 03/028894 | A2 | | 4/2003 |

OTHER PUBLICATIONS

Takeuchi Toru, "Paint Supply Apparatus," Feb. 8, 1986, JP 61-171527 (Abst.).*

* cited by examiner

METHOD AND APPARATUS FOR COATING A SUBSTRATE

CROSS-REFERENCE TO RELATED APPLICATIONS

This application is a continuation-in-part of U.S. patent application Ser. No. 09/969,478 filed Oct. 2, 2001, now U.S. Pat. No. 6,641,666 which was a continuation-in-part of U.S. patent application Ser. No. 09/440,367 filed Nov. 15, 1999, now U.S. Pat. No. 6,296,706, both of which applications are herein incorporated by reference in their entirety. This application is also related to U.S. patent application Ser. Nos. 09/439,397, now abandoned, and 09/440,610, now U.S. Pat. No. 6,291,018, each filed on Nov. 15, 1999, which related patent applications are also herein incorporated by reference in their entirety.

FIELD OF THE INVENTION

This invention relates to apparatus and methods for applying a coating over a substrate and, more particularly, to apparatus and methods for blending and applying a coating material over a substrate by one or more applicators.

TECHNICAL CONSIDERATIONS

Automobile bodies are treated with multiple layers of coatings, for example primer, basecoat, and topcoat, that enhance the appearance of the automobile and also provide protection from corrosion and other environmental conditions that can deteriorate the coating appearance and the underlying car body. Currently, these coatings are applied to an automotive substrate at separate coating stations, with each station having multiple coating applicators connected to separate sources of pre-mixed coating materials. This procedure requires a great deal of floor space to accommodate each of the separate coating stations as well as the numerous applicators to apply the different coating materials onto the substrate.

In conventional automotive coating systems, the applicators are typically connected to a number of large, e.g., 200 gallon to 600 gallon (760 to 2280 liters), coating supply piping systems or "loops". Each loop supplies the applicators with a single, pre-mixed, color pigmented and fully effect-pigmented coating material. Switching blocks are used to selectively connect the applicators of a particular coating station to one of the coating loops to apply a desired coating material onto the substrate. Examples of conventional coating systems and switching blocks are described in U.S. Pat. Nos. 4,714,044; 4,532,148; 4,539,932; 4,902,352; 4,881,563; and 4,728,034, which are herein incorporated by reference in their entirety.

In these known systems, the number of coating materials or colors available for application must necessarily be limited due to the large storage and circulation requirements (760 to 2280 liters) for the coatings in the various coating supply loops. Due to this large storage requirement, it is not unusual for an automobile manufacturer to limit the available color selection for a particular automotive model to only six or seven colors. If one of these colors should prove unpopular with consumers, the manufacturer may be forced to discontinue the use of this color, resulting in a financial burden caused by the storage and/or disposal costs for the undesired color already on hand. Additionally, the pre-mixed coating materials in the coating loops are continuously agitated and/or circulated to prevent the coating components from settling. With time, this circulation can affect the perceived color of the coating material. For example, many automotive coating materials contain metallic flakes. The continuous circulation in the coating supply loops can bend or damage these metallic flakes, altering the perceived color characteristics or shading characteristics of the deposited coating.

As will be appreciated by one of ordinary skill in the automotive coating art, it would be advantageous to provide coating systems and/or methods that reduce the required number of coating stations and/or the number of coating applicators needed to apply one or more coatings over an automotive substrate. It would further be advantageous to provide coating methods and/or apparatus that can increase the colors available for an automaker without unduly increasing storage costs for the coating materials.

SUMMARY OF THE INVENTION

A method of applying a coating onto a substrate comprises providing a coating source including a plurality of waterborne color components, dynamically blending selected color components to form a plurality of coating materials of selected color, directing the coating materials to separate reservoirs, and selectively directing a coating material from one or more of the reservoirs over the substrate by one or more applicators. The substrate can be positioned on a rotatable and/or tiltable turntable. The coating source can include a first dynamic mixing system comprising a plurality of first coating materials of differing color.

A method of applying a composite basecoat over a substrate comprises providing a substrate, applying at least one first basecoat layer over at least a portion of the substrate by a non-dynamic coating system, and applying at least one second basecoat layer over at least a portion of the first basecoat layer by a dynamic coating system.

A further method of applying a composite basecoat over a substrate comprises providing a substrate, and applying at least one first basecoat layer over at least a portion of the substrate by a non-dynamic coating system, the first basecoat layer being of a first color. At least one second basecoat layer can be applied over at least a portion of the first basecoat by a dynamic coating system. The dynamic coating system can comprise a plurality of first coating components of differing color. The second basecoat layer can be formed by dynamically mixing selected first coating components to provide a second basecoat material of a selected second color.

Another method of applying a composite basecoat over a substrate comprises providing a substrate having at least one non-dynamically applied first basecoat layer, and dynamically applying at least one second basecoat layer over at least a portion of the first basecoat layer.

DESCRIPTION OF THE PREFERRED EMBODIMENTS

Figure 1:
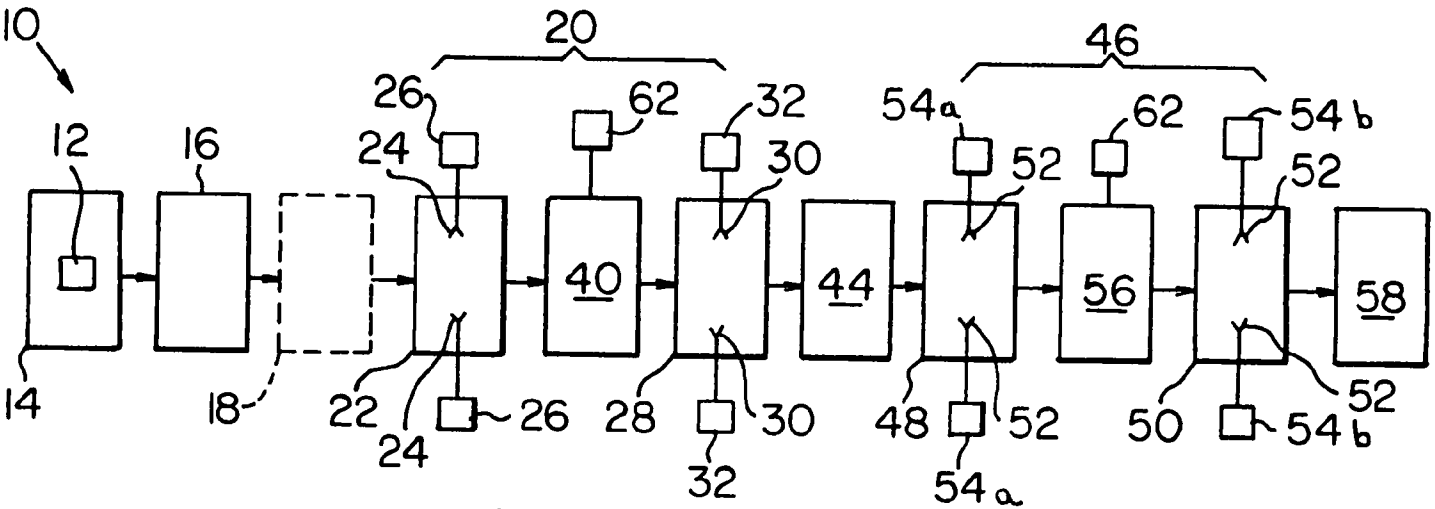
FIG. 1 is a schematic block diagram (not to scale) of a coating system according to the present invention.

As used herein, spatial or directional terms, such as "left", "right", "inner", "outer", "above", "below", "top", "bottom", and the like, relate to the invention as it is shown in the drawing figures. However, it is to be understood that the invention may assume various alternative orientations and, accordingly, such terms are not to be considered as limiting. Further, as used herein, all numbers expressing dimensions, physical characteristics, processing parameters, quantities of ingredients, reaction conditions, and the like, used in the specification and claims are to be understood as being modified in all instances by the term "about". Accordingly, unless indicated to the contrary, the numerical values set forth in the following specification and claims are approximations that may vary depending upon the desired properties sought to be obtained by the present invention. At the very least, and not as an attempt to limit the application of the doctrine of equivalents to the scope of the claims, each numerical value should at least be construed in light of the number of reported significant digits and by applying ordinary rounding techniques. Moreover, all ranges disclosed herein are to be understood to include the beginning and ending range values and to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more and ending with a maximum value of 10 or less, e.g., 5.5 to 10. Molecular weight quantities used herein, whether Mn or Mw, are those determinable from gel permeation chromatography using polystyrene as a standard. Also, as used herein, the term "polymer" includes oligomers, homopolymers, and copolymers.

FIG. 1 schematically depicts a coating system 10 incorporating features of the invention. This system 10 is suitable for coating substrates in a batch method or a continuous method. In a batch method, the forward movement of the substrate is temporarily stopped during each treatment step. In a continuous method, the substrate is in continuous movement along an assembly line or during the treatment step.

Useful substrates that can be coated according to the method of the present invention include, but are not limited to, metal substrates, polymeric substrates (such as thermoset materials and thermoplastic materials), and combinations thereof. Useful metal substrates that can be coated according to the method of the present invention include ferrous metals such as iron, steel, and alloys thereof, non-ferrous metals such as aluminum, zinc, magnesium and alloys thereof, and combinations thereof. Preferably, the substrate is formed from cold rolled steel, electrogalvanized steel such as hot dip electrogalvanized steel or electrogalvanized iron-zinc steel, aluminum, or magnesium.

Useful thermoset materials include polyesters, epoxides, phenolics, and polyurethanes such as reaction injected molding urethane (RIM) thermoset materials, and mixtures thereof. Useful thermoplastic materials include thermoplastic polyolefins such as polyethylene and polypropylene, polyamides such as nylon, thermoplastic polyurethanes, thermoplastic polyesters, acrylic polymers, vinyl polymers, polycarbonates, acrylonitrile-butadiene-styrene (ABS) copolymers, EPDM rubber, copolymers, and mixtures thereof.

The substrates can be used as components to fabricate automotive vehicles, including but not limited to automobiles, trucks, and tractors. The substrates can have any shape, e.g., in the shape of automotive body components, such as bodies (frames), hoods, doors, fenders, bumpers, and/or trim, for automotive vehicles. While the invention will be discussed generally in the context of coating a metallic automobile body substrate, one skilled in the art would understand that the methods and devices of the present invention also are useful for coating non-automotive substrates, such as motorcycles, bicycles, appliances, and the like.

With reference to FIG. 1, a substrate 12, such as a metal substrate, can be cleaned and degreased and a pretreatment coating, such as CHEMFOS 700® zinc phosphate or BONAZINC® zinc-rich pretreatment (each commercially available from PPG Industries, Inc. of Pittsburgh, Pa.), can be deposited over the surface of the substrate 12 at a pretreatment zone 14. Alternatively or additionally, one or more electrodepositable coating compositions (such as POWER PRIME® coating material commercially available from PPG Industries, Inc. of Pittsburgh, Pa.) can be electrodeposited upon at least a portion of the metal substrate 12 at an electrodeposition zone 16. Useful electrodeposition methods and electrodepositable coating compositions include conventional anionic or cationic electrodepositable coating compositions, such as epoxy or polyurethane-based coatings. Examples of some suitable electrodepositable coatings are discussed in U.S. Pat. Nos. 4,933,056; 5,530,043; 5,760,107; and 5,820,987, which are incorporated herein by reference.

The coated substrate 12 can be rinsed, heated, and cooled and then a primer layer can be applied to the substrate 12 at an optional primer zone 18 before subsequent rinsing, baking, cooling, sanding, and sealing operations. The primer coating composition can be liquid, powder slurry, or powder (solid), as desired. The liquid or powder slurry primer coating can be applied to the surface of the substrate 12 by any suitable coating method well known to those skilled in the automotive coating art, for example, by dip coating, direct roll coating, reverse roll coating, curtain coating, spray coating, brush coating, and combinations thereof. Powder coatings are generally applied by electrostatic deposition. The method and apparatus for applying the primer composition to the substrate 12 is determined in part by the configuration and type of substrate material. Non-limiting examples of useful primers are disclosed in U.S. Pat. Nos. 4,971,837; 5,492,731; and 5,262,464, which are incorporated herein by reference. The amount of film-forming material in the primer generally ranges from about 37 to about 60 weight percent on a basis of total resin solids weight of the primer coating composition. In another non-limiting aspect of the invention, the substrate 12 can include one or more basecoat layers (e.g., first basecoat layers) deposited using conventional coating methods and then one or more subsequent basecoat layers can be dynamically deposited as described below.

In one embodiment of the present invention shown in FIG. 1, a basecoat is applied over the substrate 12 in a multi-step method at a basecoat zone 20 comprising one or more basecoat application stations. For example, a first basecoat station 22 has one or more applicators, e.g., bell applicators 24, in flow communication with a first basecoat material supply 26 which supplies at least one first basecoat material or component to the bell applicator(s) 24. A second basecoat station 28 has one or more applicators, e.g., bell applicators 30, in flow communication with a second basecoat material supply 32 which supplies at least one second basecoat material or component to the bell applicator(s) 30.

As described more fully below, the first basecoat material can be applied, e.g., sprayed, over the substrate 12 by one or more bell applicators 24 at the first basecoat station 22 in one or more spray passes to form a first basecoat layer over the substrate 12 and the second basecoat material can be sprayed over the first basecoat material at the second basecoat station 28 by one or more bell applicators 30 in one or more spray passes to form a second basecoat layer. A composite basecoat of the invention is thus formed by one or more second basecoat layers applied over one or more first basecoat layers. As used herein, the terms "layer" or "layers" refer to general coating regions or areas which can be applied by one or more spray passes but do not necessarily mean that there is a distinct or abrupt interface between adjacent layers, i.e., there can be some migration of components between the first and second basecoat layers.

In one aspect of the present invention, both the first and second basecoat materials are liquid, preferably waterborne, coating materials. As used herein, the term "waterborne" means that the solvent or carrier fluid for the coating material primarily or principally comprises water. For example, in one embodiment, the carrier fluid can be greater than 80 weight percent water. The first basecoat material generally comprises a film-forming material or binder, and a volatile material. The first basecoat material may also include color pigments to provide the material with a particular color. However, in one embodiment, the first basecoat material is substantially free of effect pigment. By "effect pigment" is meant a material that can be used to provide a coating having a polychromatic effect. By "polychromatic effect" is meant a coating that shows significant contrast in color and darkness depending upon the viewing angle. A desired polychromatic effect is one in which the coated substrate appears lighter in direct observation and darker at a viewing angle of about 60° to about 80°, preferably with a shift in color from direct to angular observation. Exemplary effect pigments include mica flakes, aluminum flakes, bronze flakes, coated mica, nickel flakes, tin flakes, silver flakes, copper flakes, and combinations thereof. As used herein, "substantially free of effect pigment" means that the material comprises less than about 3% by weight of effect pigment on a basis of total weight of the material, e.g., less than about 1% by weight, e.g., is free of effect pigment.

For example, the first basecoat material can comprise a crosslinkable coating composition comprising at least one thermosettable film-forming material, such as acrylics, polyesters (including alkyds), polyurethanes, and epoxies, and at least one crosslinking material. Thermoplastic film-forming materials, such as polyolefins, also can be used. The amount of film-forming material in the liquid basecoat material generally ranges from about 40 to about 97 weight percent on a basis of total weight solids of the basecoat material. The components of the basecoat materials will be discussed in detail below.

The solids content of the liquid basecoat material generally ranges from about 15 to about 60 weight percent, e.g., about 20 to about 50 weight percent. In an alternative embodiment, the first basecoat material can be formulated from functional materials, such as primer components, which provide, for example, chip resistance to provide good chip durability and color appearance, possibly eliminating the need for a separate spray-applied primer.

With reference to FIG. 1, the first basecoat material can be applied over the substrate 12 at the first basecoat station 22 using one or more bell applicators 24. The structure and operation of conventional bell applicators will be understood by one of ordinary skill in the art and, hence, will not be discussed in further detail herein. Non-limiting examples of suitable conventional bell applicators include Eco-Bell or Eco-M Bell applicators commercially available from Behr Systems Inc. of Auburn Hills, Mich.; Meta-Bell applicators commercially available from ABB/Ransburg Japan Limited of Tokyo, Japan; G-1 Bell applicators commercially available from ABB Flexible Automation of Auburn Hills, Mich.; or Sames PPH 605 or 607 applicators commercially available from Sames of Livonia, Mich.; or the like. The first basecoat layer can be applied to any desired thickness, such as about 5 to about 30 microns, e.g., about 8 to about 20 microns.

The first basecoat material can be a pre-mixed, waterborne material substantially free of effect pigment as described above and supplied to the one or more bell applicators 24 in the first basecoat station 22 in conventional manner, e.g., by metering pumps. However, in another aspect of the invention, the first basecoat material applied over the substrate 12 at the first basecoat station 22 can be dynamically mixed from two or more individual components during the coating method. As used herein, the terms "dynamically mixed" or "dynamic mixing" mean mixing or blending two or more components to form a mixed or blended material as the components flow toward an applicator, e.g., a bell applicator, during the coating process. "Dynamically apply" means applying a material using a dynamic mixing system.

To better understand the dynamic mixing concept of the invention, an exemplary dynamic coating device 86 according to the present invention (shown in FIG. 3) will now be discussed. The coating device 86 comprises a plurality of coating component supplies, such as a first component supply 76 containing a first coating component, a second component supply 80 containing a second coating component, and a third coating component supply 88 containing a third coating component, each of which is in flow communication with an applicator conduit 90 via respective coating conduits 92. A transport device, such as a fixed or variable displacement pump 94, can be used to move one or more selected components through the conduits 90, 92. A mixer 96, e.g., a conventional dynamic flow mixer such as a pipe mixer (part no. 511-353) commercially available from Graco Equipment, Inc. of Minneapolis, Minn., is located in the applicator conduit 90 and at least one applicator, e.g., a bell applicator 98, is located downstream of the mixer 96. A conventional color change apparatus 100 or similar control device, such as a Moduflow Colorchange Stack commercially available from Sames of Livonia, Mich., can be used to control the flow rate of the various coating components received from the supplies 76, 80, and/or 88. While the dynamic mixing concept of the invention is described herein with reference to supplying the mixed material to one or more bell applicators, the dynamic mixing method of the present invention is not limited to use with bell applicators but could be used to supply other types of applicators, such as one or more gun applicators.

For purposes of the present discussion regarding application of the first basecoat layer at the first basecoat station 22, the first, second, and third coating component supplies 76, 80, and 88 may each comprise a waterborne coating component substantially free of effect pigment and each preferably of a differing primary color such that the color of the first coating material applied over the substrate 12 can be varied by changing the amounts of the selected coating components supplied to the bell applicator 98. Additional examples of dynamic coating devices of the invention, which are also suitable for application of the first and/or second basecoat layers over the substrate 12, are discussed below.

With continued reference to FIG. 1, the first basecoat material can be applied over the substrate at the first basecoat station 22 utilizing a conventional spraybooth having an environmental control system designed to control one or more of the temperature, relative humidity, and/or air flow rate in the spraybooth. However, as discussed below, in one embodiment of the invention, special temperature or humidity controls may not be required during the spray application of the first basecoat layer at the first basecoat station 22.

With reference to suitable basecoat components, suitable acrylic polymers include copolymers of one or more of acrylic acid, methacrylic acid, and alkyl esters thereof, such as methyl methacrylate, ethyl methacrylate, hydroxyethyl methacrylate, butyl methacrylate, ethyl acrylate, hydroxyethyl acrylate, butyl acrylate, and 2-ethylhexyl acrylate, optionally together with one or more other polymerizable ethylenically unsaturated monomers including vinyl aromatic compounds such as styrene and vinyl toluene, nitriles such as acrylonitrile and methacrylonitrile, vinyl and vinylidene halides, and vinyl esters such as vinyl acetate. Other suitable acrylics and methods for preparing the same are disclosed in U.S. Pat. No. 5,196,485 at column 11, lines 16-60, which is incorporated herein by reference.

Polyesters and alkyds are other examples of resinous binders useful for preparing the basecoating composition. Such polymers can be prepared in a known manner by condensation of polyhydric alcohols, such as ethylene glycol, propylene glycol, butylene glycol, 1,6-hexylene glycol, neopentyl glycol, trimethylolpropane, and pentaerythritol, with polycarboxylic acids, such as adipic acid, maleic acid, fumaric acid, phthalic acids, trimellitic acid, or drying oil fatty acids.

Polyurethanes also can be used as the resinous binder of the basecoat. Useful polyurethanes include the reaction products of polymeric polyols, such as polyester polyols or acrylic polyols with a polyisocyanate, including aromatic diisocyanates, such as 4,4'-diphenylmethane diisocyanate, aliphatic diisocyanates, such as 1,6-hexamethylene diisocyanate, and cycloaliphatic diisocyanates such as isophorone diisocyanate and 4,4'-methylene-bis(cyclohexyl isocyanate).

Suitable crosslinking materials include aminoplasts, polyisocyanates, polyacids, polyanhydrides, and mixtures thereof. Useful aminoplast resins are based on the addition products of formaldehyde, with an amino- or amido-group carrying substance. Condensation products obtained from the reaction of alcohols and formaldehyde with melamine, urea, or benzoguanamine are most common. Useful polyisocyanate crosslinking materials include blocked or unblocked polyisocyanates such as those discussed above for preparing the polyurethane. Examples of suitable blocking agents for the polyisocyanates include lower aliphatic alcohols such as methanol, oximes such as methyl ethyl ketoxime, and lactams such as caprolactam. The amount of the crosslinking material in the basecoat coating composition generally ranges from about 5 to about 50 weight percent on a basis of total resin solids weight of the basecoat coating composition.

Although the first basecoat material is preferably a waterborne coating material, the first basecoat material also can comprise one or more other volatile materials, such as organic solvents and/or amines. Non-limiting examples of useful solvents which can be included in the basecoat material, in addition to any provided by other coating components, include aliphatic solvents such as hexane, naphtha, and mineral spirits; aromatic and/or alkylated aromatic solvents such as toluene, xylene, and SOLVESSO 100; alcohols such as ethyl, methyl, n-propyl, isopropyl, n-butyl, isobutyl and amyl alcohol, and m-pyrol; esters such as ethyl acetate, n-butyl acetate, isobutyl acetate, and isobutyl isobutyrate; ketones such as acetone, methyl ethyl ketone, methyl isobutyl ketone, diisobutyl ketone, methyl n-amyl ketone, and isophorone; glycol ethers and glycol ether esters such as ethylene glycol monobutyl ether, diethylene glycol monobutyl ether, ethylene glycol monohexyl ether, propylene glycol monomethyl ether, propylene glycol monopropyl ether, ethylene glycol monobutyl ether acetate, propylene glycol monomethyl ether acetate, and dipropylene glycol monomethyl ether acetate. Useful amines include alkanolamines.

Other additives, such as UV absorbers, rheology control agents, or surfactants can be included in the first basecoat material, if desired. Additionally, the first basecoat material can include color (non-effect) pigments or coloring agents to provide the first basecoat material with a desired color. Non-limiting examples of useful color pigments include iron oxides, lead oxides, carbon black, titanium dioxide, and colored organic pigments such as phthalocyanines. As discussed above, the first basecoat material is substantially free of effect pigments. By "effect pigment" is meant a material that can be used to provide a coating having a polychromatic effect. Exemplary effect pigments include mica flakes, aluminum flakes, bronze flakes, coated mica, nickel flakes, tin flakes, silver flakes, copper flakes, and combinations thereof. As used herein, "substantially free of effect pigment" means that the basecoat material comprises less than about 3% by weight of effect pigment on a basis of total weight of the first basecoat material, e.g., less than about 1% by weight, e.g., is free of effect pigment.

After the first basecoat layer is applied at the first basecoat station 22, the coated substrate 12 enters a first flash chamber 40 in which the air velocity, temperature and humidity are controlled to control evaporation from the deposited first basecoat layer to form a first basecoat layer with sufficient moisture content or "wetness" such that a substantially smooth, substantially level film of substantially uniform thickness is obtained without sagging.

In one embodiment, within about 15 to about 45 seconds after completion of the application of the first basecoat layer, the substrate 12 is positioned at the entrance of the first flash chamber 40 and slowly moved therethrough in assembly-line manner at a rate which promotes the volatilization and stabilization of the first basecoat layer. The rate at which the substrate 12 is moved through the first flash chamber 40 depends in part on the length and configuration of the first flash chamber 40, but in one embodiment the substrate 12 is in the first flash chamber 40 for about 10 to about 180 seconds, e.g., about 20 to about 60 seconds. The air can be supplied to the first flash chamber 40 by a blower or dryer 62. A non-limiting example of a suitable blower is an ALTIVARR 66 blower commercially available from Square D Corporation. The air can be circulated at about 20 feet per minute (FPM) (0.10 m/s) to about 150 FPM (0.76 meters/second) air velocity at the surface of the coating, e.g., about 50 FPM (0.25 m/s) to about 80 FPM (0.41 meters/sec) air velocity, and can be heated to a temperature of about 50° F. (10.0° C.) to about 90° F. (32.5° C.), e.g., about 70° F. (21.1° C.) to about 80° F. (26.7° C.), e.g., about 75° F. (24.0° C.), and relative humidity of about 40% to about 80%, e.g., about 60% to about 70%, e.g., about 65% relative humidity. The air can be recirculated through the first flash chamber 40 since it is not located in a spray zone and, therefore, is essentially free of paint particulates. While in the embodiment described above, the substrate 12 moves through the flash chamber 40, it is to be understood that the substrate 12 also can be stopped in the flash chamber 40 during the flash step.

Contrary to previous thinking, it is believed that the quality of a deposited coating material is more a function of the atomization method and drying conditions subsequent to spray application than the temperature and humidity within a conventional spray booth during application of the coating. It now has been determined that the evaporation rate from the surface of the applied film can be a significant factor in deposited droplet film knit and coalescence. The coating method of the invention, utilizing a flash chamber 40 of the invention between basecoat layer applications, focuses on temperature and humidity control of the wet droplet applied film rather than on environmental control during the spray process itself, contrary to previous coating methods. Utilizing the flash chamber 40 in accordance with the invention eliminates or reduces the need for a conventional environmentally controlled spraybooth at the first basecoat station 22 when applying the first basecoat layer.

The substrate 12 is conveyed from the flash chamber 40 and the second, effect pigment-comprising basecoat layer is applied over the first basecoat layer at the second basecoat station 28 by one or more bell applicators 30. The second basecoat material can be a pre-mixed, effect pigment-comprising waterborne coating material as described above. Alternatively the second basecoat material can be dynamically mixed using a coating device similar to the coating device 86 discussed above but in which one or more of the coating components in the coating component supplies 76, 80, or 88 comprise effect pigment or effect-pigmented and/or colored coating components which can be dynamically mixed to form the second basecoat material. In one embodiment, the thickness of the second basecoat layer can be about 3 to about 15 microns, e.g., about 5 to about 10 microns.

The second basecoat material contains similar components (such as film-forming material and crosslinking material) to the first basecoat material but further comprises one or more effect pigments. Non-limiting examples of effect pigments useful in the practice of the invention include mica flakes, aluminum flakes, bronze flakes, coated mica, nickel flakes, tin flakes, silver flakes, copper flakes, and combinations thereof. The specific pigment to binder ratio can vary widely so long as it provides the requisite hiding at the desired film thickness and application solids and desired polychromatic effect. The amount of effect pigment in the second basecoat material is that which is sufficient to produce a desired polychromatic effect. In one embodiment, the amount of effect pigment ranges from about 0.5 to about 40 weight percent on a basis of total weight of the second basecoat material, e.g., about 3 to about 15 weight percent.

Examples of waterborne basecoat materials suitable for use as first and/or second basecoat materials include those disclosed in U.S. Pat. Nos. 4,403,003; 5,401,790; and 5,071,904, which are incorporated by reference herein. Also, waterborne polyurethanes, such as those prepared in accordance with U.S. Pat. No. 4,147,679, can be used as the resinous film-former in the basecoat materials, which is incorporated by reference herein. Suitable film formers for organic solvent-based basecoats are disclosed in U.S. Pat. No. 4,220,679 at column 2, line 24 through column 4, line 40 and U.S. Pat. No. 5,196,485 at column 11, line 7 through column 13, line 22, which are incorporated by reference herein.

One skilled in the art would understand that multiple layers of the first and/or second basecoat materials can be applied, if desired. Also, alternating layers can be applied. The thickness of the composite basecoat, i.e., the combined thickness of the first and second basecoat layers applied to the substrate 12, can vary based upon such factors as the type of substrate and intended use of the substrate, i.e., the environment in which the substrate is to be placed and the nature of the contacting materials. Generally, the thickness of the overall basecoat ranges from about 10 to about 38 microns, and preferably about 12 to about 30 microns. While the second basecoat material can be applied in a conventional spraybooth, in a preferred practice of the invention special temperature or humidity controls generally are not required.

Applying the effect pigment-containing second basecoat layer over the first basecoat layer after stabilization of the first basecoat material in the flash chamber 40 has been found to permit the effect pigment in the second basecoat layer to correctly orient to provide the desired polychromatic effect even when using bell applicators for the application of both basecoat layers.

The first basecoat layer can be applied as a full-opaque functional coat or a semi-opaque color pigmented coat. The method of the invention provides a deep, color-rich base to which the metallic second basecoat layer can be applied. In the composite basecoat of the present invention, the effect pigment provided in the second basecoat layer preferably is present only in about the outer 60%, more preferably the outer 40% of the total composite basecoat thickness. This coating procedure thus utilizes less effect pigment than conventional basecoats which use effect pigment throughout the entire basecoat thickness and, hence, is more economically desirable to automakers.

With continued reference to FIG. 1, after application of the second basecoat layer, the composite basecoat can be flashed in a flash chamber 40 as described above before further processing. Alternatively, the composite basecoat formed over the surface of the substrate 12 can be dried or cured at a conventional drying station 44 after application of the second basecoat layer. For waterborne basecoats, "dry" means the almost complete absence of water from the composite basecoat. Drying the basecoat enables application of a subsequent protective clearcoat, as described below, such that the quality of the clearcoat will not be adversely affected by further drying of the basecoat. If too much water is present in the basecoat, the subsequently applied clearcoat can crack, bubble or "pop" during drying of the clearcoat as water vapor from the basecoat attempts to pass through the clearcoat.

The drying station 44 can comprise a conventional drying oven or drying apparatus, such as an infrared radiation oven commercially available from BGK-ITW Automotive Group of Minneapolis, Minn. The basecoat can be dried to form a film which is substantially uncrosslinked, i.e., is not heated to a temperature sufficient to induce significant crosslinking, and there is substantially no chemical reaction between the thermosettable film-forming material and the crosslinking material.

After the basecoat on the substrate 12 has been dried (and cured and/or cooled, if desired) in the drying station 44, a clearcoat is applied over the basecoat at a clearcoat zone 46 comprising at least one clearcoat station, e.g., first and second clearcoat stations 48 and 50, respectively, each having one or more bell applicators 52 in flow communication with a supply 54*a* and 54*b*, respectively, of clearcoat material to apply a composite clearcoat over the dried basecoat. The clearcoat materials in the supplies 54*a* and 54*b* can be different or the same material. A second flash chamber 56 (similar to flash chamber 40) can be positioned between the first and second clearcoat stations 48 and 50 so that the clearcoat material applied at the first clearcoat station 48 can be flashed under similar conditions as described above before application of clearcoat material at the second clearcoat station 50.

The clearcoat can be applied by conventional electrostatic spray equipment, such as high speed (e.g., about 30,000-60, 000 rpm) rotary bell applicators 52 at a high voltage (about 60,000 to 90,000 volts), to a total thickness of about 40-65 microns in one or more passes. The clearcoat material can be liquid, powder slurry (powder suspended in a liquid) or powder (solid), as desired. Preferably, the clearcoat material is a crosslinkable coating comprising one or more thermosettable film-forming materials and one or more crosslinking materials such as are discussed above. Useful film-forming materials include epoxy-functional film-forming materials, acrylics, polyesters, and/or polyurethanes, as well as thermoplastic film-forming materials, such as polyolefins, can be used. The clearcoat material can include additives such as are discussed above for the basecoat, but preferably not effect pigments. If the clearcoat material is a liquid or powder slurry, volatile material(s) can be included. The clearcoat material may be a "tinted" material, e.g., comprising about 3 to about 5 weight percent of coloring pigment on a basis of the total weight of the clearcoat material.

The clearcoat material can be a crosslinkable coating comprising at least one thermosettable film-forming material and at least one crosslinking material, although thermoplastic film-forming materials, such as polyolefins, can be used. A non-limiting example of a waterborne clearcoat is disclosed in U.S. Pat. No. 5,098,947 (incorporated by reference herein) and is based on water-soluble acrylic resins. Useful solvent borne clearcoats are disclosed in U.S. Pat. Nos. 5,196,485 and 5,814,410 (incorporated by reference herein) and include epoxy-functional materials and polyacid curing agents. Suitable powder clearcoats are described in U.S. Pat. No. 5,663,240 (incorporated by reference herein) and include epoxy functional acrylic copolymers and polycarboxylic acid crosslinking agents, such as dodecanedioic acid. The amount of the clearcoat material applied to the substrate can vary based upon such factors as the type of substrate and intended use of the substrate, i.e., the environment in which the substrate is to be placed and the nature of the contacting materials.

In one embodiment, the present invention further comprises curing the applied liquid clearcoat material at a drying station 58 after application over the dried basecoat. As used herein, "cure" means that any crosslinkable components of the material are substantially crosslinked. This curing step can be carried out by any conventional drying technique, such as hot air convection drying using a hot air convection oven (such as an automotive radiant wall/convection oven which is commercially available from Durr, Haden or Thermal Engineering Corporation) or, if desired, infrared heating, such that any crosslinkable components of the liquid clearcoat material are crosslinked to such a degree that the automobile industry accepts the coating method as sufficiently complete to transport the coated automobile body without damage to the clearcoat. Generally, the liquid clearcoat material is heated to a temperature of about 120° C. to about 150° C. (184° F. to 238° F.) for a period of about 20 to about 40 minutes to cure the liquid clearcoat.

Alternatively, if the basecoat was not cured prior to applying the liquid clearcoat material, both the basecoat and the liquid clearcoat material can be cured together by applying hot air convection and/or infrared heating using conventional apparatus to individually cure both the basecoat and the liquid clearcoat material. To cure the basecoat and the liquid clearcoat material, the substrate 12 is generally heated to a temperature of about 120° C. to about 150° C. (184° F. to 238° F.) for a period of about 20 to about 40 minutes.

In one embodiment, the thickness of the dried and crosslinked composite clearcoat is generally about 12 to about 125 microns, e.g., about 20 to about 75 microns.

Figure 2:
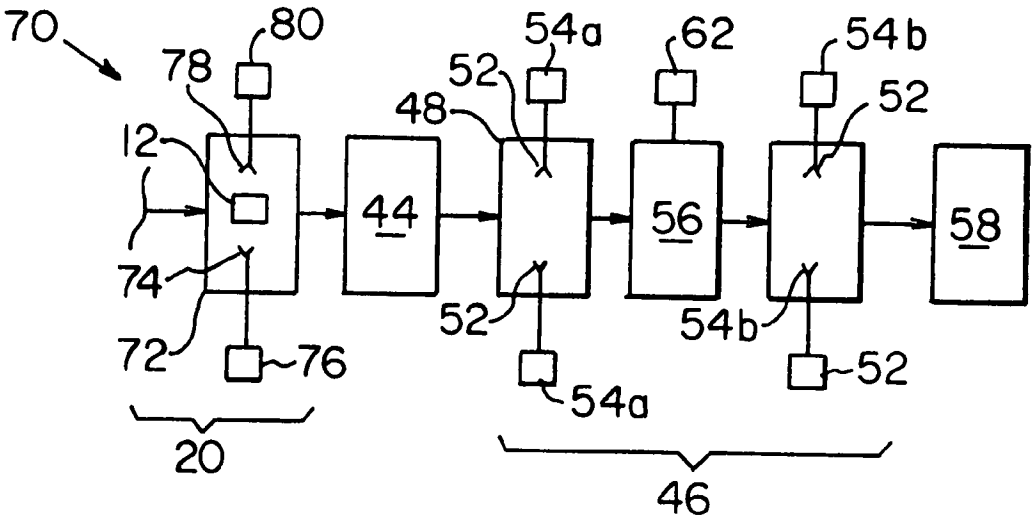
FIG. 2 is a schematic block diagram (not to scale) of an alternative embodiment of a coating system according to the present invention.

An alternative coating system 70 incorporating further aspects of the present invention is shown in FIG. 2. In this system 70, the composite basecoat is applied onto the substrate 12 at a single basecoat station 72. Prior to application of the composite basecoat, the substrate 12 can be pretreated, electrocoated, and/or primed as described above. The basecoat station 72 can include one or more applicators, for example, one bell applicator 74 can be connected to a supply 76 of first basecoat material, e.g., a waterborne coating material substantially free of effect pigment, and another bell applicator 78 can be connected to a supply 80 of second basecoat material, e.g., a waterborne coating material comprising effect pigment. In this system 70, the bell applicator 74 applies the first basecoat material over the substrate 12 in one or more spray passes to produce a substantially non-effect pigment-containing first basecoat layer over the substrate. The first basecoat layer can be flashed, dried, or partially dried by the application of heated air over the substrate 12 at the basecoat station 72. The second basecoat material is applied over the first basecoat layer in one or more spray passes by the second bell applicator 78 to provide a polychromatic, composite basecoat as described above. Alternatively, the second basecoat material can be applied "wet on wet" over the first basecoat material. By "wet on wet" is meant that after the application of the first basecoat material, the coated substrate is subjected to the ambient atmosphere in the spray station or basecoat station 72, e.g., for about 10 secs. to 180 secs., and then the second basecoat material is applied over the first basecoat material to form a composite basecoat. The composite basecoat can be dried in a drying station 44 and clearcoated in a clearcoat zone 46 before curing in a drying station 58, all substantially as described above. Alternatively, the first and second basecoat materials can be applied wet on wet as described above and the clearcoat material applied wet on wet over the basecoat. The substrate with the basecoat and clearcoat materials can then be dried or cured in a drying station.

Figure 3:
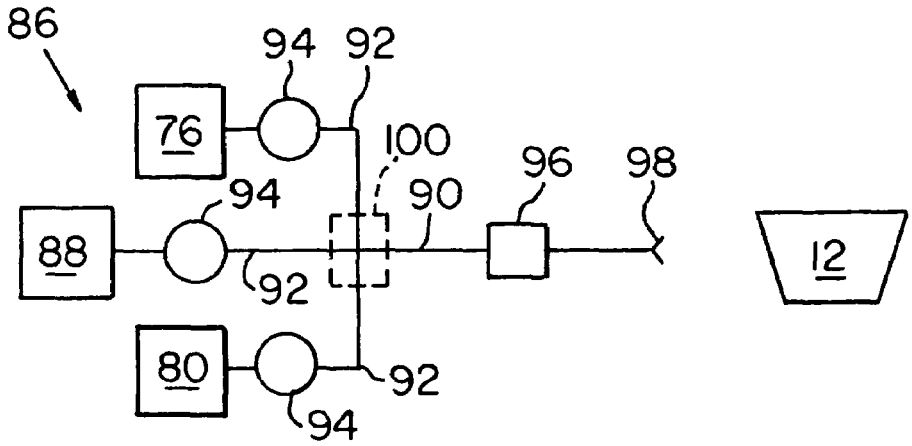
FIG. 3 is a schematic diagram (not to scale) of an exemplary dynamic coating device according to the present invention.

In the system 70 described above, separate bell applicators were connected to the first and second basecoat material supplies 76 and 80. However, in the practice of the invention, a single bell applicator could also be used to apply primer, first and second basecoat materials, and/or clearcoat over the substrate 12. Any or each of these coating materials can be mixed dynamically before application over the substrate. For example, a selected conventional waterborne color formulation can comprise at least two coating components, a first component having color pigment but which is substantially free of effect pigment and a second, effect-pigmented component. With reference to FIG. 3, these two components, along with a conventional clear blending base, can be contained in the first component supply 76, second component supply 80, and third component supply 88, respectively, of the coating device 86.

Referring to FIG. 3, predetermined amounts of the substantially effect pigment-free first component (in supply 76) and the base (in supply 88) can be pumped through the applicator conduit 90 and dynamically mixed in the mixer 96 to form the first coating material. The first coating material can be applied onto the substrate 12 in one or more spray passes by flow through the bell applicator 98 to form the first basecoat layer. After application of the first basecoat layer, the flow of the first component (in supply 76) can be stopped and the flow of the second component (in supply 80) started to mix the second component and the base material in the mixer 96 to form the effect pigment-containing second basecoat material, which is then sprayed over the first basecoat material in one or more spray passes to form the second basecoat layer.

Figure 4:
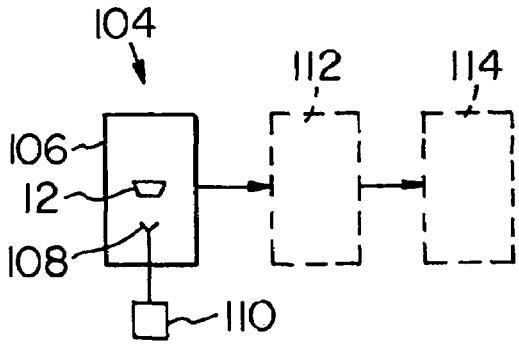
FIG. 4 is a schematic block diagram (not to scale) of an alternative embodiment of a coating system according to the invention.

An alternative embodiment of a coating system 104 incorporating additional features of the invention is shown in FIG. 4. The coating system 104 replaces the basecoat zone 20 and clearcoat zone 46 in FIGS. 1 and 2 with a multi-dynamic coating zone 106. As explained below, in the multi-dynamic coating zone 106 the substrate 12 can be coated with a primer or functional primer (if desired), a basecoat of a selected color and/or effect, and a clearcoat by using a single applicator, e.g., bell applicator 108, connected to a dynamic coating system, e.g., coating system 110 shown in FIG. 5 and discussed further below.

Figure 5:
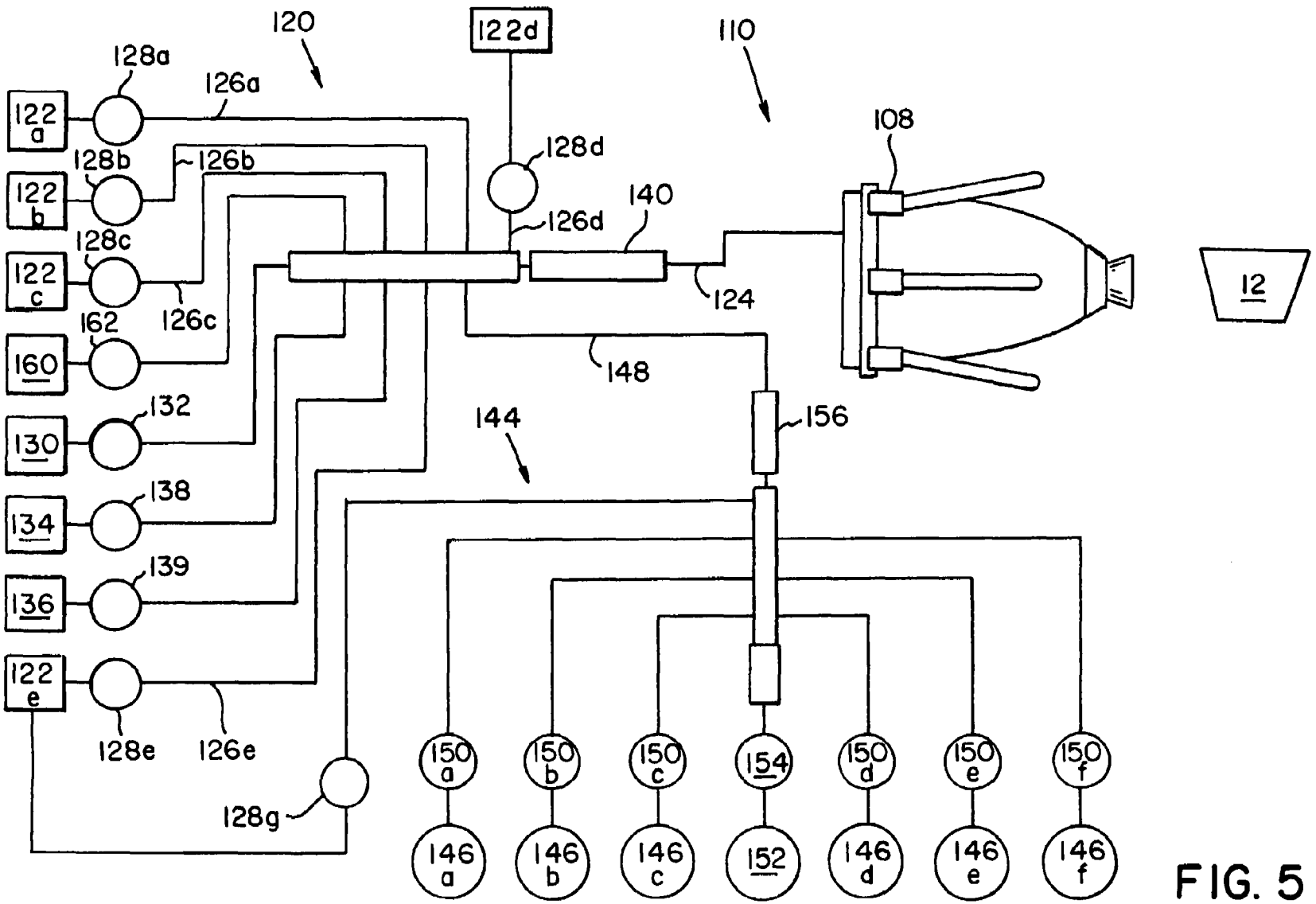
FIG. 5 is a schematic diagram (not to scale) of a dynamic coating device according to the present invention.

With reference to FIG. 5, the dynamic coating system 110 comprises a first dynamic mixing system 120 having a plurality of coating supplies 122*a*-122*e* each containing waterborne, substantially non-effect pigmented coating components preferably of different primary colors, such as red 122*a*, yellow 122*b*, blue 122*c*, white 122*d*, and black 122*e*. A separate coating conduit 126*a*-126*e* is connected between each coating supply 122 and a conventional transport device, such as pumps 128*a*-128*e*, to transport selected coating components from the individual coating supplies 122*a*-122*e* through a first mixer 140 and a first conduit 124 to an applicator, such as a bell applicator 108. As described more fully below, the first mixer 140 can be used to mix one or more of the coating components from selected coating supplies 122*a*-122*e* and/or a first waterborne base component from a first base supply 130 to form a coating material of a selected color. The pumps 128*a*-128*e* can be fixed, positive displacement or variable displacement pumps, such as 0.6 to 3.0 cc/revolution positive displacement flushable-face gear pumps commercially available from Behr Systems Inc. of Auburn Hills, Mich.

The first base supply 130 is in flow communication with the first conduit 124 through a first base pump 132. Additional coating component supplies, such as a weathering component supply 134 or flexibility component supply 136 can also be in flow communication with the first conduit 124 via pumps 138 and 139, respectively. Examples of suitable flexibility and weathering components include ultraviolet absorbers, hindered amine light stabilizers, or antioxidants. Additionally, one or more primer component supplies 160 containing primer component(s) for application onto the substrate prior to basecoating can be in flow communication with the first conduit 24 by a primer pump 162. Examples of suitable primer components are discussed above.

In one embodiment, the dynamic coating system 110 further comprises a second dynamic mixing system 144 which can be in flow communication with the applicator 108 and/or the first dynamic mixing system 120. The second dynamic mixing system 144 can include a plurality of different effect pigment component supplies 146*a*-146*f*. For example, supply 146*a* can contain red mica flakes, supply 146*b* can contain blue mica flakes, supply 146*c* can contain green mica flakes, supply 146*d* can contain yellow mica flakes, supply 146*e* can contain coarse aluminum flakes, and supply 146*f* can contain fine aluminum flakes, in flow communication with a second conduit 148 through respective effect pigment pumps 150*a*-150*f*. For example, yellow and blue mica flakes can be mixed to form a green tinted material.

The system 144 can further comprise a second base supply 152 containing a second waterborne base component preferably having a different, preferably lower, viscosity than the first base component. The second base supply 152 is in flow communication with the second conduit 148 via a second base pump 154. An optional second mixer 156 is in flow communication with the second conduit 148 upstream of the position at which the second conduit 148 communicates with the first conduit 124 and can be used to mix one or more of the effect pigment-containing components from the supplies 146*a*-146*f* with the second base component before entering the first conduit 124. As shown in FIG. 5, one or more of the first supplies 122, e.g., supply 122*e*, also can be in flow communication with the second conduit 148 by an auxiliary pump 128*g* to pump one or more selected waterborne coating components directly into the second conduit 148, if desired.

With the dynamic coating system 110, the first basecoat material can be dynamically mixed from one or more of the primary-colored coating components received from the first supplies 122*a*-122*e* to produce a first basecoat material of a desired color. For example, selected individual primary-colored coating components can be pumped from selected first supplies 122*a*-122*e* into the first conduit 124 and dynamically mixed in the first mixer 140 to provide the first basecoat material of a desired color before entering the bell applicator 108 and being sprayed onto the substrate 12 in one or more spray passes to form the first basecoat layer. The amount of each coating component and/or first base component and, hence, the final color of the first basecoat material, can be controlled using a conventional electronic or computerized control device (not shown) or proportioning valve system, such as an RCS (ratio control system) device commercially available from ITW Ransburg or ITW Finishing Systems of Indianapolis, Ind.; or conventional specialized multiple valve control systems commercially available from Behr Systems Inc. of Auburn Hills, Mich.

After application of the first basecoat layer is complete or nearly complete, selected effect pumps 150*a*-150*f* and the second base pump 154 are started to blend one or more selected effect pigment-containing components from selected effect pigment supplies 146*a*-146*f* with the second base component from the second base supply 152. This effect pigment-containing composition can be mixed with selected coating components from the first supplies 122*a*-122*e* in the second mixer 156 and enters the first conduit 124 upstream of the first mixer 140 to produce an effect pigment-containing second basecoat material which is sprayed over the first basecoat material in one or more spray passes to form the second basecoat layer. The effect pigment-containing second basecoat material pushes any remaining first basecoat material out of the first conduit 124 through the bell applicator 108, thus lessening or ameliorating the need for a purging of the bell applicator 108 before application of the second basecoat material. Although in the preferred embodiment described above, the mixed second basecoat material passes through the first mixer 140 before entering the bell applicator 108, it should be understood that the second conduit 148 alternatively could be connected directly to the bell applicator 108 such that the mixed second basecoat material would not pass through the first mixer 140 before entering the bell applicator 108. Alternatively, the second mixer 156 can be deleted and all of the components mixed by the first mixer 140.

In the method described above, both the first and second basecoat materials were colored materials, i.e., formed with an amount of a color pigmented coating component from the coating supplies 122*a*-122*e*. However, it should be understood that the second mixing system 144 can be used to apply a transparent or semi-transparent second basecoat layer onto the substrate 12 by pumping clear or tinted basecoat component from the second base supply 152 and selected effect pigment-containing components into the first conduit 124 after application of the first basecoat layer(s).

Figure 6:
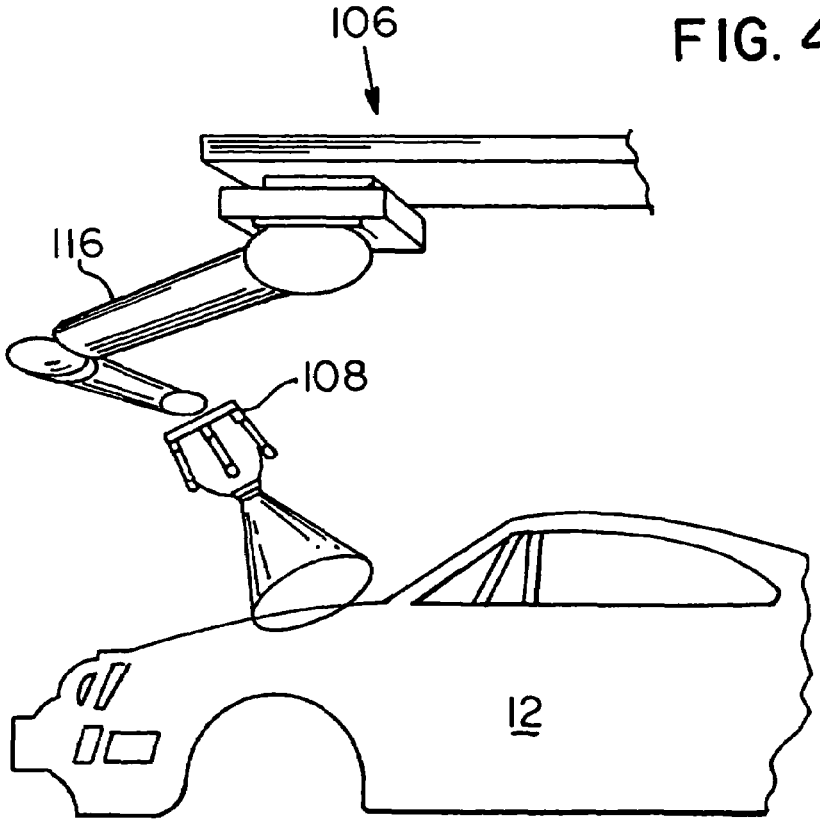
FIG. 6 is a side elevational view (not to scale) of a dynamic coating system according to the present invention.

FIG. 6 is a side elevational view of the multi-dynamic coating zone 106 showing the bell applicator 108 mounted on a movable robot arm 116 to permit the bell applicator 108 to move in x, y, and/or z directions to coat all or substantially all of the substrate 12 surface. As will be understood by one of ordinary skill in the automotive coating art, this dynamic coating system 110 can be used to apply a plurality of coating materials, such as functional primers, flexibility coats, weathering coats, clear coats, etc., in series, as desired, onto the substrate 12. Thus, the system 110 could operate to apply substantially all sprayable coatings onto an automotive substrate 12 after an electrodeposition coat or corrosion coat, such as coil-coated BONAZINC, is applied.

For example, with reference to FIGS. 5 and 6, a substrate, such as an electrodepositon coated substrate 12, can be moved into the multi-dynamic coating zone 106 where a functional coating, such as functional primer, can be supplied using the system 110 shown in FIG. 5. The primer component from the primer supply 160 can be pumped by the primer pump 162 into the first conduit 124 and applied by the bell applicator 108 over the substrate. The primer pump 162 can be stopped, and selected coating pumps 128*a*-128*e* and the first base pump 132 started to apply the first basecoat material of a selected color over the substrate. The first basecoat material pushes the remaining primer coating material ahead of it as it is mixed in the first mixer 140 and out of the bell applicator 108. The bell applicator 108 can be traversed around the substrate 12 by the robot arm 116 to apply the first basecoat layer onto the substrate 12. The second basecoat material can then be provided by starting the second base pump 154 and selected effect pumps 150*a*-150*f*, and optionally stopping or slowing the coating pumps 128*a*-128*e* and/or first base pump 132. The second basecoat material pushes the remaining first basecoat material ahead of it and out of the bell applicator 108.

To apply a clearcoat over the basecoat, the effect pumps 150*a*-150*f* can be stopped and one or both of the first and second base pumps 132 and 154 started. The second base component is preferably of a different, e.g., lower, viscosity than the first base component and can be used as a clearcoat base. The viscosity of the clearcoat, or any of the other coating material supplied by the dynamic coating system 110, can be varied by the addition of different amounts of the two base components to the dynamically blended coating material. It is to be understood that between the applications of the different coating materials in the coating zone 106, the substrate can be flashed, dried or partially dried, or cured in the coating zone 106, for example, by the application of heated air.

After the application of the desired coatings, e.g., primer, basecoat(s), and/or clearcoat(s), in the multi-dynamic coating zone 106, the substrate 12 may optionally be transported through a flash chamber 112 (similar to flash chamber 40 as described above) and/or through a drying station 114 (similar to drying station 44 described above) for final curing.

Figure 7:
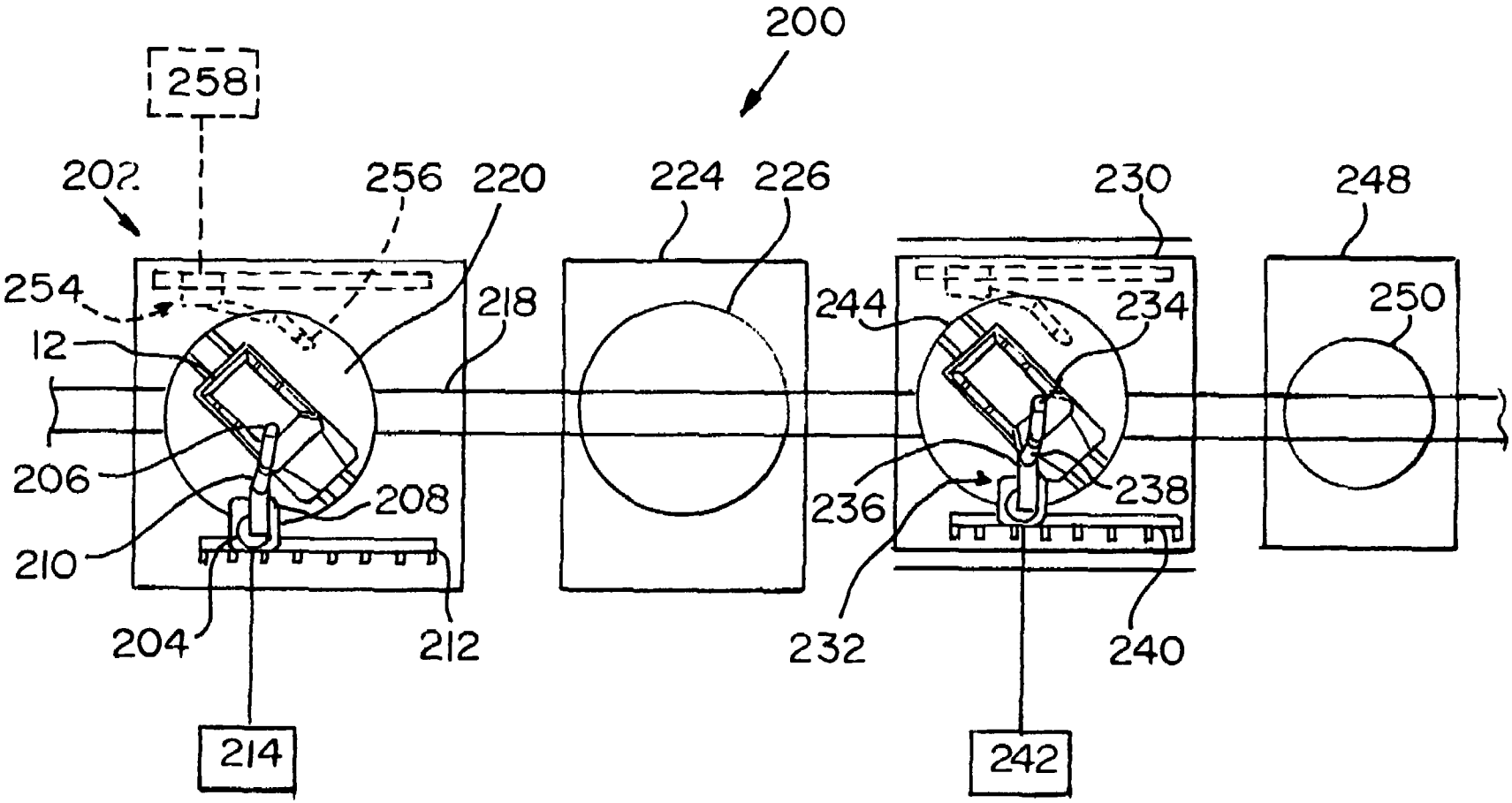
FIG. 7 is a schematic plan view (not to scale) of another coating system of the invention.

Another coating apparatus or system 200 of the invention is shown in FIG. 7. The coating system 200 includes at least one coating station 202 (shown in side view in FIG. 8). The coating station 202 includes at least one coating device 204. In one embodiment, the coating device 204 includes at least one applicator 206, such as a bell applicator, movably mounted on a conventional robot 208 having an articulated arm 210. The robot 208 can be movably mounted on a guide or track 212 so that the robot 208 is movable in, e.g., along, the coating station 202. The coating device 204 is in flow communication with a source 214 of coating material, such as the coating system 110 described above and shown in FIG. 5. Alternatively, the coating device 204 can be connected to a conventional coating loop or to a modified coating system described below and shown in FIG. 9.

Figure 8:
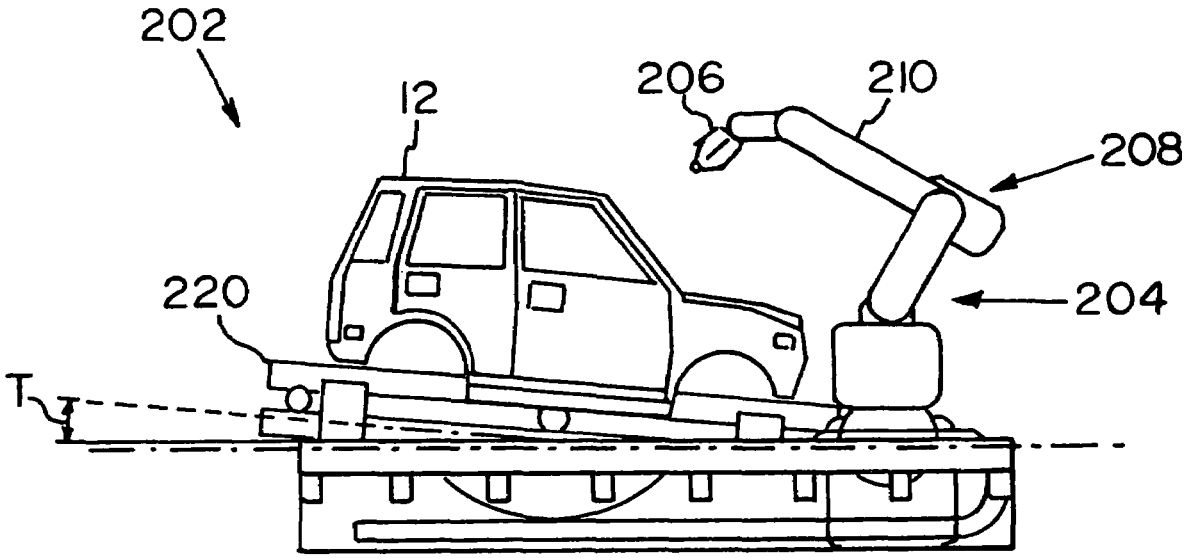
FIG. 8 is a side view (not to scale) of a coating station of FIG. 7.

A conveyor 218, such as a belt conveyor, chain conveyor, rail conveyor, or any suitable conventional conveyor, extends through the coating system 200 to transport the substrate 12 through the coating system 200. As shown in FIGS. 7 and 8, a positioning device, such as a rotatable and/or tiltable turntable 220, is located along the conveyor 218 in the coating station 202 so that the substrate 12 can be moved by the conveyor 218 onto the positioning device. The turntable 220 can be a conventional hydraulic or pneumatic turntable that is rotatable, e.g., rotatable about 360°. The turntable 220 can also be tiltable around a center pivot point (FIG. 8) such that, as described below, a substrate 12 located on the turntable 220 can be rotated and/or tilted to position the substrate 12 for easier application of a coating by the one or more applicators 206 on the movable robot arm 210. In one non-limiting embodiment shown in FIG. 8, the turntable 220 has a maximum degree of tilt T of less than or equal to 15°, such as less than 5° to 10°, with respect to the floor of the coating station 202. The turntable can have any rotation speed, e.g., 0.5 feet per minute (15 cm per minute) to 200 feet per minute (508 cm per minute). In the exemplary embodiment shown in FIG. 7, the conveyor 218 is depicted as a rail conveyor with a pair of spaced rails extending through the coating system 200. However, it is to be understood that this is simply one type of conveyor that can be used and that the invention is not limited to rail conveyors.

The coating system 200 can also include a dehydration station 224 to set and/or dry the coating applied in the coating station 202 before further treatment. The dehydration station 224 can be, for example, a flash chamber 40 or a drying station 44 as described above or a conventional flash chamber or oven. The conveyor 218 can extend through the dehydration station 224 to convey the substrate 12 through the station 224 in either a continuous or non-continuous (i.e., stopping the movement of the substrate 12 when in the station 224) manner. In one alternative embodiment shown in FIG. 7, the dehydration station 224 can include an optional positioning device, such as a turntable 226, to rotate and/or tilt the substrate 12 in the dehydration station 224.

The coating system 200 can also include a second coating station 230 having at least one coating device 232 with at least one applicator 234, such as a bell applicator, movably mounted on a conventional robot 236 having an articulated arm 238. The robot 236 can be movably mounted on a guide or track 240. The coating device 232 is connected to a source 242 of coating material, such as clearcoat material. A positioning device, such as a rotatable and/or tiltable turntable 244, can be located in the second coating station 230.

The coating system 200 can also include a drying station 248 (e.g., similar to drying station 58 described above), to dry and/or cure the applied coatings. In one embodiment, the drying station 248 can include an optional rotatable and/or tiltable turntable 250.

One exemplary method of operation of the coating system 200 will now be described. Prior to application of a coating, such as a composite basecoat, at the coating station 202, the substrate 12 can be pretreated, electrocoated, and/or primed as described above. The substrate 12 to be coated can be placed on a conventional carrier and moved into and through the coating station 202 by the conveyor 218. The carrier holding the substrate 12 is moved along the conveyor 218 and onto the turntable 220. The carrier preferably includes one or more conventional locking devices to temporarily attach or hold the carrier to the conveyor 218 when on the turntable 220. For example and not to be considered as limiting, the locking devices can be conventional hydraulic or pneumatic clamps that engage or clamp onto the turntable 220 or that portion of the conveyor 218 located on the turntable 220 so that when the carrier is on the turntable 220, the turntable 220 can be rotated and/or tilted without throwing the substrate 12 and carrier off of the turntable 220. Alternatively, conventional locking or clamping devices can be located on the turntable 220 to grip or hold the carrier in place when on the turntable 220. In FIG. 7, the turntable 220 and associated portion of the conveyor 218 thereon are depicted as rotated about forty-five degrees from the direction of movement of the substrate 12 along the coating system 200.

The coating device 204 and turntable 220 can be operatively connected to one or more control devices (not shown), such as a conventional computer control device, to control the movement of the coating device 204 and/or turntable 220 during the coating operation. For example, when the substrate 12 is on the turntable 220, the turntable 220 can be activated to rotate and/or incline the substrate 12. As the substrate 12 is rotated and/or tilted by the turntable 220, the robot 208 can move along the track 212 so that the applicator 206 can be positioned or moved at the same time the substrate 12 on the turntable 220 is moved. Movement of the applicator 206 and simultaneous rotation and/or tilting of the substrate 12 facilitates applying a coating onto all sides of the substrate 12. The coating can be, for example, a single layer coating or a composite coating, applied in similar manner as described above with respect to FIGS. 2 and 4. If a multilayer coating is applied, the coating layers can be applied wet on wet as described above. For example, a first basecoat material can be applied followed by a flash at ambient conditions in the coating station 202, e.g., for about 10 secs. to about 180 secs., prior to application of a second basecoat material over the first basecoat material. The second basecoat material can be flashed under ambient conditions, e.g., for about 10 secs. to about 180 secs., and then one or more clearcoat materials applied. Alternatively, one or more basecoat materials can be applied in the coating station 202 and then the coated substrate can be moved out of the coating station 202 for further processing and clearcoating as described below.

For example, after application of a coating, e.g., a composite basecoat, at the coating station 202, the turntable 220 is returned to its initial position, i.e., aligned with the conveyor 218, and the substrate 12 can be transported by the conveyor 218 to the dehydration station 224 so that the coating can be set or dried in similar manner as described above with respect to FIG. 4. In one embodiment, the coated substrate 12 can be rotated and/or inclined by the optional turntable 226. This rotation can promote more uniform heating of the coated substrate 12.

The substrate 12 can then be moved to the second coating station 230 by the conveyor 218 where a second coating, such as a single layer or multi-layer clearcoat, can be applied by the coating device 232 over the first coating. In similar manner as described above with respect to the coating station 202, the rotation and/or tilting of the turntable 244 and the movement of the applicator 234 can be coordinated by a control device (not shown) to facilitate coating the substrate 12.

After application of the second coating, the substrate 12 can be moved by the conveyor 218 into the drying station 248 for drying and/or curing of the first and/or second coatings. In one embodiment, the substrate 12 can be rotated and/or inclined by the optional turntable 250 during drying and/or curing to promote more even drying and/or curing of the coating(s).

In the coating system 200 described above, the substrate 12 was described as being coated in the first and second coating stations 202 and 230 by a single robotic coating device 204 and 232 having a single applicator 206 and 234. However, it is to be understood that the coating device 204 can have a plurality of applicators 206 connected to the robot 208. Additionally, a second movable robotic coating device 254 having one or more applicators 256 can also be positioned at the coating station 202. The second coating device 254 can be attached to a separate source 258 of coating material or to the same coating material source 214 as the first coating device 204. The two coating devices 204 and 254 can be attached to a control device (not shown) to control simultaneous movement of the applicators 206, 256 and turntable 220 to more efficiently coat the substrate 12.

Figure 9:
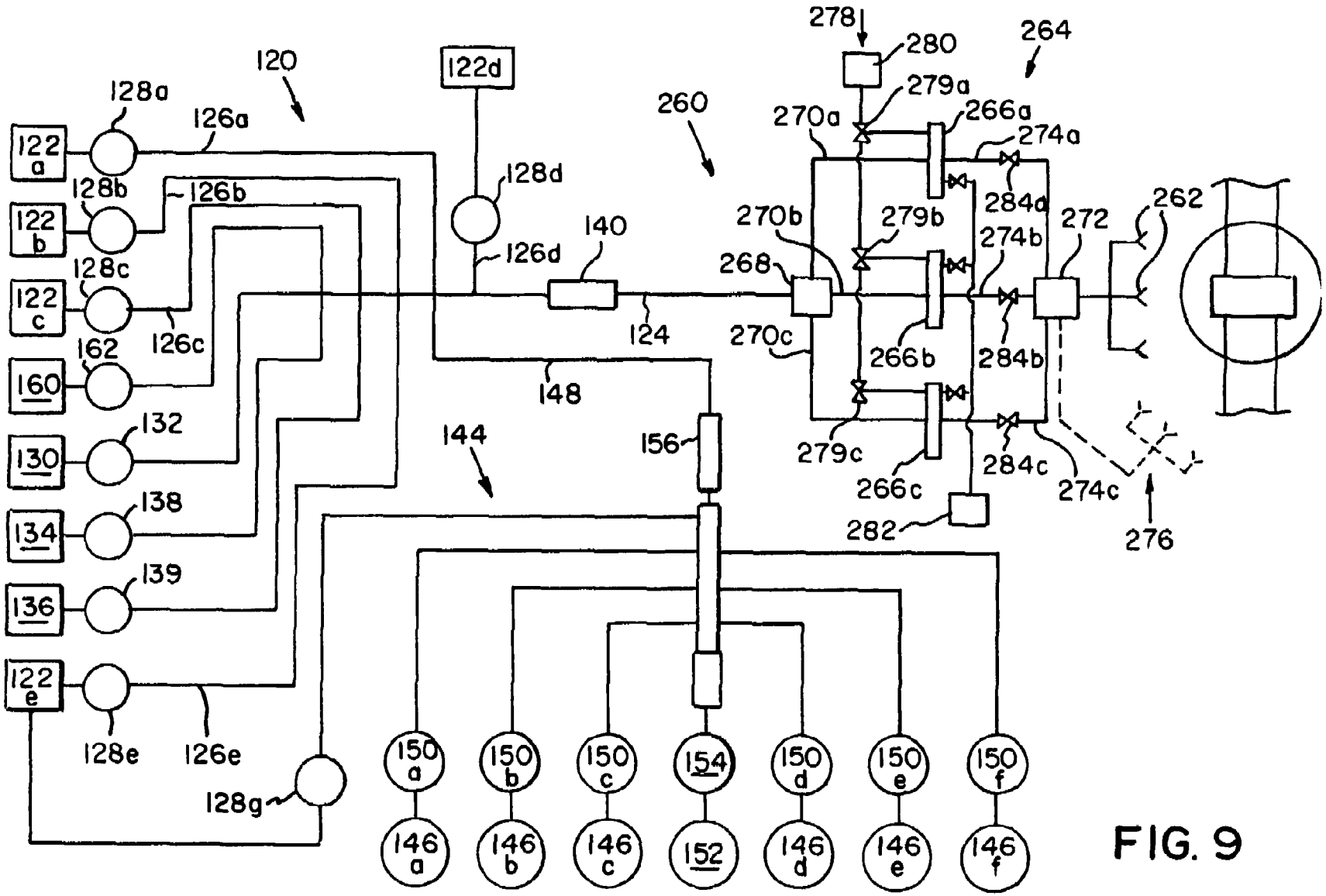
FIG. 9 is a schematic view (not to scale) of another coating apparatus of the invention.

One or more of the coating material sources 214, 258 can be conventional coating loops having several hundred gallons of coating material per loop. Alternatively, one or more of the sources 214, 258 can include the coating system 110 as described above. In a still further embodiment of the invention, one or more of the coating sources 214, 258 can be a further coating apparatus 260 of the invention shown in FIG. 9. The coating apparatus 260 includes some elements of the dynamic coating system 110 shown in FIG. 5 and like reference numbers are used to indicate like elements in FIGS. 5 and 9. However, in the coating apparatus 260, the first and second dynamic mixing systems 120, 144 are in flow communication with one or more applicators 262, such as bell applicators, through a reservoir system 264 having one or more holding tanks or reservoirs 266*a*-266*c*. As shown in FIG. 9, the conduit 124 is connected to a first directional control device or valve 268 which is in turn connected to at least one, and preferably a plurality, of reservoirs 266*a*-266*c* by conduits 270*a*-270*c*. The reservoirs 266*a*-266*c* are in turn connected to a second directional control device or valve 272 by conduits 274*a*-274*c*. At least one, and preferably a plurality, of the applicators 262 are connected to the second directional control valve 272 either individually or in groups.

In operation, one or more of the first coating components from the first dynamic mixing system 120 and/or second coating components from the second dynamic mixing system 144 can be mixed or directed into a selected one of the reservoirs 266*a*-266*c* through the first directional control valve 268. For example, the first coating components can be selected such that a red coating material is dynamically blended and directed to the reservoir 266*a*, a blue coating material blended and directed to the reservoir 266*b*, and a green coating material blended and directed to the reservoir 266*c*. Each of the reservoirs 266*a*-266*c* can include a conventional recirculation device, such as a recirculation pump and associated piping, to prevent the coating materials, e.g., color pigments and/or metal flakes, from settling out. If a red coating is desired to be deposited onto the substrate 12, the second directional control valve 272 connects the reservoir 266*a* to the applicators 262 to apply the red coating material onto the substrate 12. If a subsequent substrate is to be coated with a green coating material, the second directional control valve 272 can be shifted, either manually or automatically through a conventional control device (not shown), to stop the flow of red coating material from the reservoir 266*a* and start the flow of coating material from the reservoir 266*c*. While the green coating material is being drawn from the reservoir 266*c*, the first and/or second dynamic mixing systems 120, 144 can be used to replenish the depleted red coating material from the reservoir 266*a* so that when the next substrate to be coated with a red coating is transported into the coating station, the reservoir 266*a* is again full or at least has a desired level of red coating material contained therein. In this manner, the coating apparatus 260 can be used to replenish used coating material from one or more of the reservoirs 266*a*-266*c* while a selected coating material is being supplied to the applicators 262.

As shown in FIG. 9, one or more additional applicators 276 or set of applicators 276 can be connected to the second directional control valve 272. Thus, one applicator 262 or set of applicators 262 can be connected to one of the reservoirs, such as the reservoir 266*a*, by the second directional control valve 272 and another applicator 276 or set of applicators 276 can be connected to a different reservoir, such as reservoir 266*b*, by the second directional control valve 272. In this way, two different coating materials can be simultaneously applied onto a substrate to achieve a multi-tone, such as two-tone, color effect on the substrate.

The coating apparatus 260 can also include a cleaning system 278 having a cleaning tank 280 connected to each of the reservoirs 266*a*-266*c*, e.g., by conduits having inlet valves 279*a-c*. The reservoirs 266*a*-266*c* are in turn connected, e.g., by waste conduits, to a waste tank 282 through waste valves 284*a*-284*c*. The second directional control valve 272 can also be connected to the waste tank 282. The cleaning system 278 can be used to clean or flush the reservoirs 266*a*-266*c* and associated conduits. For example, in the scenario described above, if no further red coating material is required for a particular operational cycle, the waste valve 284*a* can be opened to align the reservoir 266*a* with to the waste tank 282. Cleaning fluid from the cleaning tank 280 can be directed into the reservoir 266*a* through the inlet valve 279*a* to rinse the red coating material out of the reservoir 266*a*. The waste valve 284*a* can then be closed and the first and/or second dynamic mixing systems 120, 144 can be used to supply another coating material, such as a purple coating material, into the cleaned reservoir 266*a*.

The process of the present invention can provide improved color flexibility and greater total package solids compared to the use of conventional metallic basecoat materials alone. The dynamic mixing process provides the ability to have a large color palette for both solid color and metallic colors using relatively few blending base colors or metallic blending colors. Solids in the total basecoat package also can be increased. A controllable color contrast change can be achieved based on the blend combination of the first basecoat layer solid color and the blend combination and relative film thickness of the second basecoat layer metallic color.

As will be understood from the above discussion, the present invention provides methods and devices for applying a basecoat, such as an effect pigment-containing composite basecoat, over a substrate using one or more applicators, e.g., bell applicators. The present invention also provides dynamic mixing systems for versatile color blending.

In the above-described exemplary embodiments, a substrate 12 could be cleaned, rinsed, primed, etc. and then a composite basecoat formed over the substrate by dynamically applying a first basecoat layer (e.g., substantially free of effect pigment) and a second basecoat layer (e.g., comprising effect pigment) using a dynamic coating system of the invention (e.g., 70, 86, 104, 110, 200, 260). However, it is to be understood that a dynamic coating system of the invention could also be advantageously used, e.g., in combination with a conventional basecoat system, to form a composite basecoat having one or more non-dynamically applied coating layers and one or more dynamically applied coating layers. For example, a dynamic coating system of the invention could be used to apply one or more dynamically deposited basecoat layers over one or more conventionally deposited basecoat layers.

In one aspect of the invention, one or more layers of a composite basecoat can be applied over the substrate 12 by a conventional (i.e., non-dynamic) coating system, such as using a bell applicator or a reciprocating gun applicator to apply a previously mixed coating material. By "non-dynamic" is meant that the coating materials are not "dynamically mixed" as defined herein. For example, a substrate 12, such as a metal substrate, can be cleaned and an optional primer coating applied over the substrate 12 as described above. A first basecoat material, such as a basecoat material described above for the first and/or second basecoat layers, can be non-dynamically applied over at least a portion of the substrate 12 to form a first basecoat layer. For example, the first basecoat layer can be non-dynamically applied using conventional bell applicators or reciprocating gun applicators. The non-dynamically applied first basecoat layer can be substantially free of effect pigment, as described in the embodiments above. Alternatively, the non-dynamically applied first basecoat layer can comprise effect pigment. In one non-limiting embodiment, the first basecoat layer can include 1 wt. % to 40 wt. % effect pigment, such as 3 wt. % to 30 wt. %, such as 5 wt. % to 25 wt. %, such as less than 20 wt. % effect pigment based on the weight of the first basecoat material.

One or more second basecoat layers can then be dynamically applied over at least a portion of the first basecoat layer(s) using one or more of the dynamic coating systems of the invention. The second basecoat layer(s) can be the same or different than the first basecoat layer(s) and can be of any of the basecoat materials described above. A clearcoat, such as described above, can be applied either dynamically or non-dynamically over at least a portion of the second basecoat layer(s).

In this aspect of the invention, automobile manufacturers can continue to utilize their existing non-dynamic coating systems to apply one or more first basecoat layers over an automotive substrate. The first basecoat layer can be of a first color, such as a color historically well received by customers of the automobile manufacturer. The one or more second, dynamically mixed basecoat layer(s) can be the same color as the first basecoat layer or, in one aspect of the invention, can be of a different color or shade than the first basecoat layer to provide a plurality of resultant composite basecoats of lighter or darker color. For example, in one embodiment, the second basecoat layer can be transparent or semi-transparent and can have one or more color pigments and/or effect pigments that compliment the color of the underlying non-dynamically applied first basecoat layer.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

What is claimed is:

1. A method of applying a coating onto a substrate, comprising the steps of:

providing a coating source including a plurality of water-borne color components;

dynamically blending selected color components to form a plurality of coating materials of selected color in a first mixer, said first mixer being connected to a plurality of separate reservoirs;

directing the coating materials from the first mixer to one or more of said reservoirs; and selectively directing a coating material from one or more of the reservoirs over at least a portion of the substrate by one or more applicators.

2. The method of claim 1, including positioning the substrate on a turntable.

3. The method of claim 2, wherein the turntable is rotatable and/or tiltable.

4. The method of claim 1, wherein the coating source includes a first dynamic mixing system comprising a plurality of first coating components of differing color.

5. The method of claim 4, wherein the first coating components are substantially free of effect pigments.

6. The method of claim 5, wherein the coating source further includes a plurality of second coating components comprising effect pigments.

7. A method of applying a composite basecoat over a substrate, comprising the steps of:

providing a substrate;

applying at least one first basecoat layer over at least a portion of the substrate by a non-dynamic coating system;

applying at least one second basecoat layer over at least a portion of the first basecoat layer by a dynamic coating system, the dynamic coating system comprising:

a plurality of coating sources;

a mixer connected to the plurality of coating sources;

a plurality of reservoirs connected to the mixer; and one or more applicators connected to one or more of the reservoirs.

8. The method of claim 7, wherein the first basecoat layer comprises effect pigment.

9. The method of claim 7, wherein the first basecoat layer is substantially free of effect pigment.

10. The method of claim 7, wherein the non-dynamic coating system includes at least one bell applicator or at least one gun applicator.

11. The method of claim 7, wherein the dynamic coating system comprises a plurality of first coating sources, said first coating sources each comprising a first coating material having differing color.

12. The method of claim 11, wherein the dynamic coating system further comprises a plurality of second coating sources, one or more of said second coating sources comprising a second coating material comprising effect pigments.

13. A method of applying a composite basecoat over a substrate, comprising:

providing a substrate;

applying at least one first basecoat layer over at least a portion of the substrate by a non-dynamic coating system, wherein the first basecoat layer is of a first color; and applying at least one second basecoat layer over at least a portion of the first basecoat by a dynamic coating system, the dynamic coating system comprising:

a plurality of coating sources, wherein each of said plurality of coating sources comprises a first coating component, one or more of the first coating components having differing color;

a mixer connected to the plurality of coating sources;

a plurality of reservoirs connected to the mixer; and one or more applicators connected to one or more of the reservoirs; and wherein the second basecoat layer is formed by dynamically mixing selected first coating components to provide a second basecoat material of a selected second color.

14. The method of claim 13, wherein the first color is different than the second color.

15. The method of claim 13, wherein the first basecoat layer comprises effect pigment.

16. The method of claim 13, wherein the second basecoat layer comprises effect pigment.

17. A method of applying a composite basecoat over a substrate, comprising:

providing a substrate having at least one non-dynamically applied first basecoat layer; and dynamically applying at least one second basecoat layer over at least a portion of the first basecoat layer by a dynamic coating system that comprises:

a plurality of coating sources;

a mixer connected to one of the plurality of coating sources;

a plurality of reservoirs connected to the mixer; and one or more applicators connected to one or more of the reservoirs.

18. The method of claim 17, wherein the dynamically applying step includes:

(a) selectively directing a plurality of first coating components from one or more of said plurality of coating sources to the mixer, one or more of said first coating components having a different color;

(b) dynamically blending the plurality of first coating components in the mixer to form a coating composition of a selected color;

(c) selectively directing the coating composition to one or more reservoirs;

(d) repeating steps (a)-(c)

(e) applying one of the coating compositions over at least a portion of the first basecoat layer.

19. The method of claim 18, wherein the first basecoat layer is of a different color than the second basecoat layer.

20. A method of applying a composite basecoat over a substrate, comprising the steps of:

(a) providing a substrate;

(b) applying at least one first basecoat layer over at least a portion of the substrate by a non-dynamic coating system;

(c) providing a dynamic coating system comprising:

a plurality of coating sources, said plurality of coating sources comprising a coating material, wherein one or more of the coating materials have a different first color;

a mixer connected to the plurality of coating sources;

a plurality of reservoirs connected to the mixer; and one or more applicators connected to one or more of the plurality of reservoirs;

(d) forming a second basecoat material having a selected second color by selectively directing one or more of the plurality of coating materials to the mixer and dynamically blending the components to form a second basecoat material in the mixer;

(e) selectively directing the second basecoat material from the mixer to one or more of the plurality of reservoirs that are connected to the mixer;

(f) repeating steps (d) and (e)

(g) selectively directing one of the second basecoat materials from the plurality of reservoirs to the one or more applicators; and (h) applying said one of the second basecoat materials over at least a portion of the first basecoat layer via the one or more applicators.

21. The method according to claim 20, wherein said second basecoat material comprises an effect pigment.

* * * * *